United States Patent [19]

Thiry et al.

[11] Patent Number: 4,506,316

[45] Date of Patent: Mar. 19, 1985

[54] PAR SPOT LAMP

[75] Inventors: William Thiry; Arnold E. Westlund, Jr.; Clarence D. Puckett, all of Winchester, Ky.

[73] Assignee: GTE Products Corporation, Stamford, Conn.

[21] Appl. No.: 524,507

[22] Filed: Aug. 18, 1983

[51] Int. Cl.[3] ..... F21V 7/00

[52] U.S. Cl. ..... 362/309; 313/113; 362/328; 362/329; 362/333; 362/334; 362/337; 362/339; 362/340

[58] Field of Search ..... 362/309, 328, 329, 333, 362/334, 337, 339, 340; 313/113

[56] References Cited

U.S. PATENT DOCUMENTS

| | | | |
|---|---|---|---|
| 3,392,277 | 7/1968 | Dawson | 362/336 |
| 4,371,916 | 2/1983 | De Martino | 362/337 |

*Primary Examiner*—Stephen J. Lechert, Jr.
*Attorney, Agent, or Firm*—Lawrence R. Fraley

[57] ABSTRACT

A spot lamp having a lens in the form of a curved member having an inner surface with a series of radially disposed flutes formed therein defining a fluted portion which surrounds a centrally disposed stippled portion. The flutes each extend linearly from a position adjacent the stippled portion outwardly to a position adjacent the outer edge of the curved member. The surfaces of the flutes are also stippled.

12 Claims, 9 Drawing Figures

PAR SPOT LAMP

TECHNICAL FIELD

The present invention relates in general to an improved spot lamp, and in particular to an improved spot lamp of the PAR variety. Even more particularly, the invention is concerned with an improved lamp lens and reflector construction having, inter alia, a visually improved spot beam pattern and improved beam candlepower distribution.

CROSS REFERENCE TO COPENDING APPLICATIONS

In Ser. No. 380,495, entitled "PAR Spot Lamp" and filed May 21, 1983 (C. D. Puckett et al), there is described a spot lamp wherein the lens contains a series of concentrically disposed fluted rings and an outer concentric region having a stippled surface.

In Ser. No. 380,496, entitled "PAR Flood Lamp" and filed May 21, 1983 (C. D. Puckett et al), there is described a flood lamp wherein the lens contains a series of concentrically disposed fluted rings and an outer concentric region containing therein a plurality of spherical protrusions.

In Ser. No. 380,491, entitled "PAR Flood Lamp" and filed May 21, 1983 (C. D. Puckett et al), there is illustrated a design for a flood lamp wherein the lens contains several concentric fluted rings surrounded by a region of several spherical protrusions.

In Ser. No. 380,492, entitled "PAR Spot Lamp" and filed May 21, 1983 (C. D. Puckett et al), there is illustrated a design for a spot lamp wherein the lens includes a central region having several concentric fluted rings and an outer stippled region.

In an application filed concurrently herewith and entitled "Spot Lamp With Radially Fluted Lens" (W. Thiry et al), there is illustrated a design for a spot lamp wherein the lens contains several radially disposed flutes surrounding a centrally oriented stippled region.

All of the aforementioned applications are assigned to the same assignee as the instant invention.

BACKGROUND

It is well known in the art to utilize PAR (parabolic aluminized reflector) lamps for general spot lighting applications. In particular, PAR 38 (those with a 4.75-inch face diameter) spot lamps have become exceptionally popular for short-to-medium-distance outdoor uses as well as indoors for display, decoration, accent, inspection, and downlighting applications. Examples of such spot lamps are manufactured and sold by the assignee of the instant invention under the product designations 75 PAR/SP, 150 PAR/SP, and 150 PAR/3SP. Typically, these lamps are of hardglass and include a medium skirt (screw-type) or side prong base at the rear thereof for connecting the lamp to the desired power source.

The beam produced by a PAR lamp is typically of substantially conical configuration and provides a substantially round pattern. This pattern changes to being oval or elliptical should the lamp be aimed at an acute angle with the light-receiving surface. These lamps also may possess a rated average life of from 2000 to 4000 hours (with many more recently introduced models exceeding this), operate readily from standard household current (120 volt) and produce a beam having an output typically ranging from about 700 to about 3300 lumens.

Prior spot lamps, such as those of the type PAR 38 variety, include, in an early version, a lens that has either a stippled or irregular lens surface typically obtained by shot or sand blasting. The stippled surface usually appears over substantially the total face of the lamp lens. The resultant light pattern from such a surface provides a generally undesired asymmetrical pattern which is essentially a function of the stipple density. Moreover, a further drawback of existing spot lamps of this type is that there is very little, if any, control of the beam pattern.

A presently existing spot lamp is also shown in the aforementioned copending application Ser. No. 380,495. As stated, the lens of this lamp has a series of concentrically disposed fluted rings on the interior surface of the lens, each ring having a progressively increased radius, in combination with an outer concentric ring portion adjacent to and wider than any one of the fluted rings. This outer concentric ring portion includes a stippled surface, also located on the interior of the lens. By combining fluted concentric rings having specified radii with different stipple densities, a more controllable, symmetrical, and pleasing (softer) spot beam pattern is realized, particularly when utilizing a standard cross-axis mounted incandescent filament (where the filament is substantially parallel to the lens). However, when the lens is used with an axially mounted filament (where the filament lies perpendicular to the lens), these lenses provide a "pinwheel" beam pattern which is undesirable in that it does not meet normal candlepower distribution criteria. Accordingly, the "pinwheel" beam pattern is generally deemed visually unacceptable as a spot beam pattern.

DISCLOSURE OF THE INVENTION

It is an object of the present invention to provide a spot lamp that has an improved lens construction and which in particular substantially diminishes the aforementioned "pinwheel" beam pattern.

Another object of the present invention is to provide an improved spot lamp construction as in accordance with the foregoing object and which further provides improved control of the resulting beam pattern.

A further object of the present invention is to provide an improved spot lamp construction that provides a uniform beam pattern with controllable candlepower distribution whether used with a cross-axis or axially mounted filament.

In accordance with the present invention, there is provided an improved spot lamp in which "pinwheel" effects are substantially diminished and in which there is provided improved control of the resulting beam pattern. In accordance with one aspect of the present invention, there is provided a lamp having, as a lens, a substantially curved member having an inner surface including therein a series of radially disposed flutes and a centrally disposed region of stippled configuration. The stippled region is substantially surrounded and thus bounded by the fluted portion. Each of the flutes extend linearly from a position adjacent the stippled portion radially outwardly to a position adjacent the outer edge of the lens member. By combining the fluted portion with the stippled region, the aforementioned "pinwheel" effect is substantially diminished, particularly when the lens is associated with an axially mounted filament. The lamp's candlepower distribution may be readily varied by altering such factors as the number of flutes, flute shape, flute location and stipple density.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
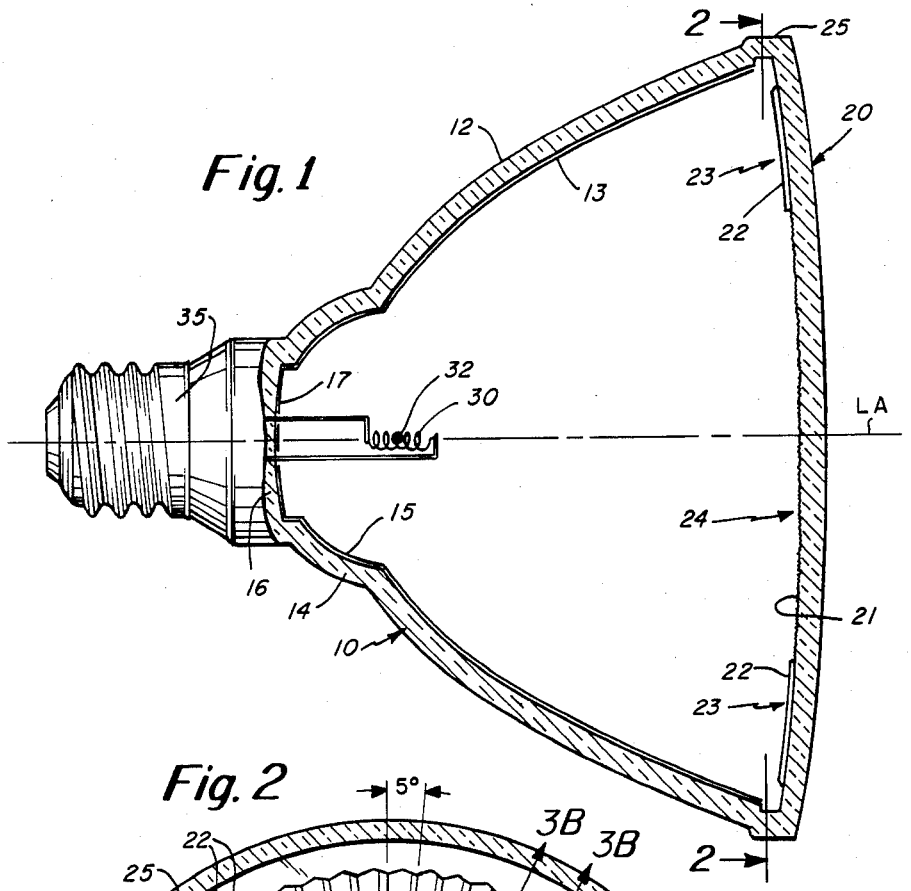
FIG. 1 is a side elevational view, partly in section, of a spot lamp constructed in accordance with the principles of this invention.
Figure 2:
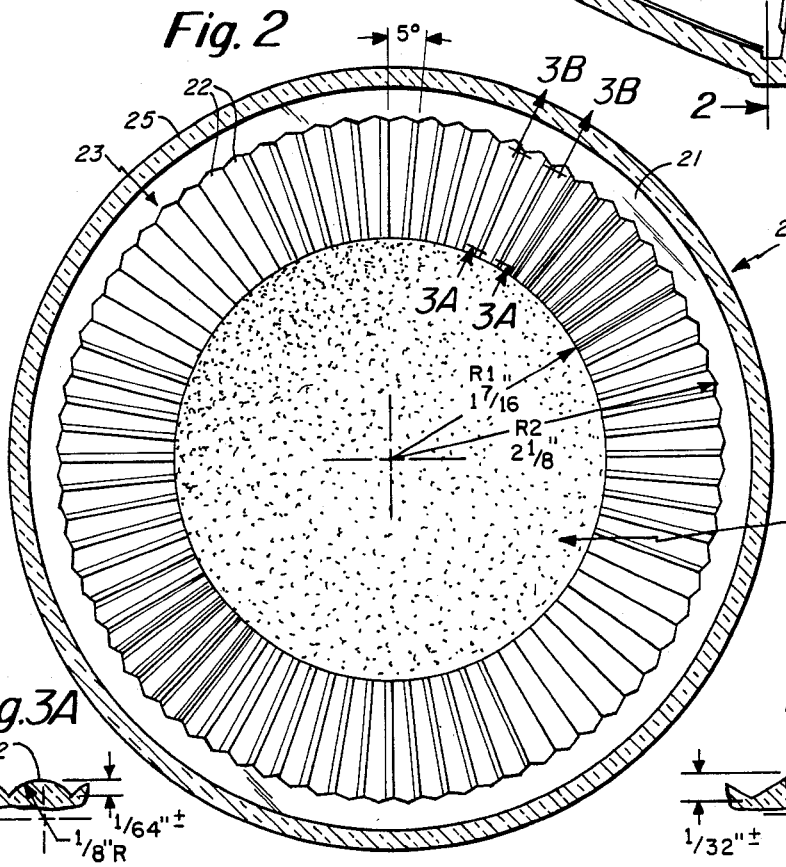
FIG. 2 is an elevational view of the interior surface of the lens member of the invention as taken along the line 2—2 in FIG. 1.

With regard to the drawings, particularly FIGS. 1 and 2, there is shown a PAR-type spot lamp that generally comprises a reflector portion 10, a lens member 20, and a light source such as filament 30. The filament 30 may be a single incandescent (e.g., tungsten) filament (as shown) which is secured to support wires (not shown) and projects into the lamp's reflecting portion. Preferably, this filament is located within (and thus part of) a pressurized halogen-containing capsule member. In FIG. 1, it is noted that filament 30 is axially oriented (along the lamp's longitudinal axis LA which is coincident with the optical axis of the reflector portion). The filament 30 is thus disposed within and substantially surrounded by reflector portion 10 as well as being substantially perpendicular to lens member 20.

In FIG. 1, the reflector portion 10 may be of conventional design or, preferably, of the three-part type described below and in aforementioned application Ser. No. 380,495. The reflector portion is combined with the slightly curved lens member 20, which in accordance with the present invention, has an internal (inner) surface 21 including therein a series of radially disposed flutes (defining a fluted portion) in addition to a stippled portion located substantially in the center thereof. In addition to the reflector and lens, the lamp in FIG. 1 also includes a metallic (e.g. aluminum) screw-in base 35, which is preferably of conventional construction. Both the reflector and lens components of the invention are of hardglass material.

Reflector portion 10 is provided with a first (front) reflecting section 12 which comprises an internal, true parabolic reflecting surface 13, thus producing a greater number of parallel rays when filament 30 is located at the principle focus 32 of this surface. In addition, reflector 10 also comprises a second (interim) reflective section 14, which comprises an internal reflecting surface 15 of substantially spherical (actually semi-spherical) configuration. The radius of spherical surface 15 is taken at the principle focus point 32 so that the center of the radius of this second section coincides with the principle focus point of parabolic surface 13. Reflector 10 also includes a third (rear) section 16 through which wiring extends in a conventional manner for providing electrical connection between base 35 and the filament. The third section 16 comprises an inner, substantially spherical (also actually semi-spherical) reflective surface 17 which may have a radius substantially the same as conventional prior lamps. The radius of the third reflective surface is greater than that of the spherical second surface 15. In one specific embodiment, the parabolic front section 12 of the reflector possessed a focal point of about 0.49 inch, the radius of curvature of the middle, spherical section 14 was about 0.86 inch, and the radius of the rear section 16 was about 2.40 inches.

The inner reflective surfaces 13, 15 and 17 of reflector 10 may be constructed of relatively smooth configuration throughout, thus being defined as planar specular. Alternatively, these inner surfaces of the reflector may be stippled (e.g., by shot blasting) to provide a diffuse specular reflective surface. Stippling of the reflective surfaces of various types of reflectors, including those of glass material, is known and further definition is not deemed necessary.

As indicated previously, in one prior spot lamp there is utilized a lens that has a totally stippled external lens surface usually obtained by shot or sand blasting. The resultant light pattern from such a surface provides a generally asymmetrical pattern which is a function solely of the stipple density. Furthermore, position control of the resulting beam pattern is exceptionally difficult to maintain. Also, in the more recent development set forth in the aforementioned copending application Ser. No. 380,495, there is provided a lens with an inner surface having a series of concentrically disposed fluted rings formed therein and an outer concentric ring portion of stippled configuration. Each of the concentric rings is disposed at a progressively increasing radius from the longitudinal axis of the spot lamp (which passes through the center of the lens). Although this more recent development provides a more controllable, symmetrical and pleasing spot beam pattern when used with a standard cross-axis (parallel to the lens) mounted incandescent filament, when used with an axially mounted filament, such a lens provides a substantially "pinwheel" beam pattern which is not considered to be visually acceptable, nor is such a pattern deemed to satisfy normal distribution criteria.

Accordingly, in accordance with the present invention, there is provided an improved lens member 20 in the form of a substantially curved member having an inner surface 21 curved in a direction toward filament 30 and including a series of radially disposed flutes 22 formed therein to thus define a fluted portion 23. The outer (external) surface of lens member 20 is substantially parallel to inner surface 21 and is smooth. Lens member 20 also includes an internal, stippled configuration portion 24, which, as noted in FIG. 2, is substantially surrounded and bounded by fluted portion 23. Each of the flutes 22, as noted in FIG. 2, extends linearly from a position adjacent the stippled portion 24 and thereby extends outwardly in a radial manner to a position adjacent the outer edge 25 of the lens member. As also depicted in the elevational view in FIG. 2, lens member 20 is substantially circular in configuration and, in one example, possessed an external diameter of about 4.750 inches (thus forming part of what can be designated as a PAR 38 lamp).

Figure 3A:
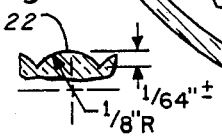
FIGS. 3A and 3B are enlarged cross-sectional views taken respectively along lines 3A—3A and 3B—3B in FIG. 2 showing further details of the fluting in FIG. 2.
Figure 3B:
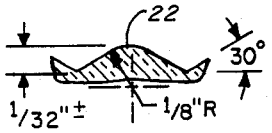

With reference to FIG. 2, and the associated cross-sectional views of FIGS. 3A and 3B, it is noted that the centrally disposed stippled portion 24 is circular in shape and thereby possesses a radius (R1). In one example, R1 was about 1.438 inches long. The flutes 22 extend from radius R1 to an outer radius R2 which, in the same example, was about 2.125 inches. The stippled portion 24 may be provided with any one of a number of different stipple densities. In FIG. 2, for example, a 110 lb. stipple was used. In addition, stippling is also provided in both portions 23 and 24, thus extending also to the surfaces of the individual flutes 22. With regard to the flutes 22 illustrated in FIG. 2, each possesses a width extending through an angle of about five degrees from the lens center. There are thus a total of seventy-two flutes in the annular array depicted in FIG. 2.

FIG. 3A shows a cross-sectional view through the end of one flute 22 located nearest the lens center illustrating therein the radius of curvature of this end and also the relative height of the flute thereat. In one example, this height was about 0.016 inch and the flute curvature (exterior) was on a radius of about 0.125 inch (FIG. 3A). FIG. 3B shows a cross-sectional view through the same flute as in FIG. 3A but at the outer end thereof showing the curvature of this end of the flute, which is a combination of a pair of linear side portions meeting at the illustrated base angle along with an outer (exterior) radius of curvature. The height of the flute at this outermost end portion is approximately twice the corresponding height at the innermost end portion depicted in FIG. 3A. It is understood that all flutes in FIG. 2 are of identical size and configuration. It is also understood from FIG. 2 that each flute is of tapered configuration. That is, each has an overall internal end width (that end width nearest the lens center) substantially less than the overall outer end width (that nearest outer edge 25), as well as a pair of opposed, straight sides which serve to inerconnect these ends. This configuration is also employed for the remaining flutes (i.e., those in FIGS. 4A–4D) described herein for use in this invention.

Figure 4A:
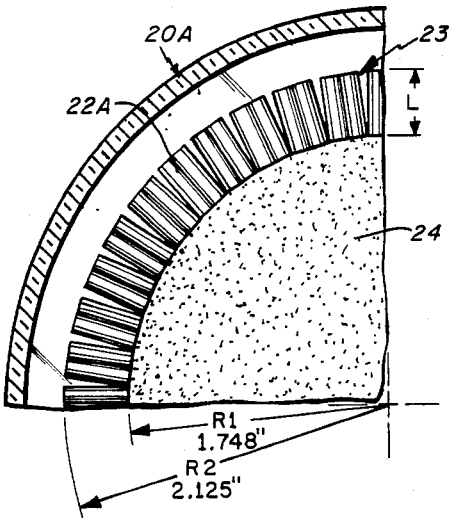
FIGS. 4A, 4B, 4C and 4D are fragmentary elevational views of possible alternate embodiments of lens members for use in this invention.

FIGS. 4A–4D show four fragmentary views of a lens member that may be constructed in accordance with alternate embodiments of the present invention. FIG. 4A shows a lens member 20A having a fluted portion 23 including a series of radially disposed flutes 22A. In this embodiment, there are provided a total of forty-four identical flutes for lens member 20A with the length of each flute being only about 0.377 inch, compared to the length of about 0.687 inch for each flute in FIG. 2. In this embodiment, the radius R1 was about 1.748 inches and the radius R2 was about 2.125 inches. A standard stipple such as defined above may be used for the stippled portion 24. Stippling was not provided on the flute surfaces.

Figure 4B:
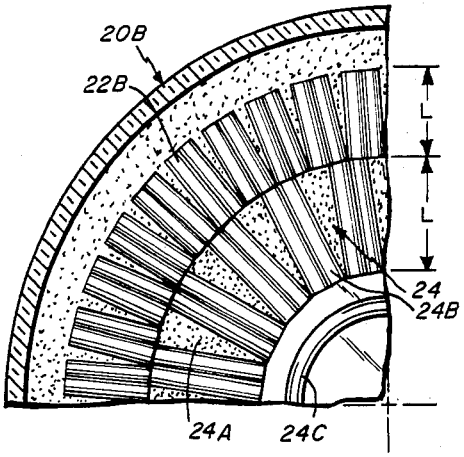

In FIG. 4B there is shown a lens member 20B having flutes 22B which may each be of a length of about 0.533 inch. In this embodiment there are a total of forty identical flutes in the annular array in the outer (peripheral) region of the lens. In the embodiment of FIG. 4B, there is also provided a second inner annular array of radially disposed flutes 24B having stippling therebetween. Flutes 24B total twenty in number over the entire lens member, thus providing a total of sixty such elements. The length of each inner flute 24B is greater than the length of each outer flute 22B. The embodiment of FIG. 4B also has a centrally disposed portion 24C which may be stippled or, as is shown, may comprise one or more concentric, fluted rings. Stippling is not provided on the flute surfaces in FIG. 4B.

Figure 4C:
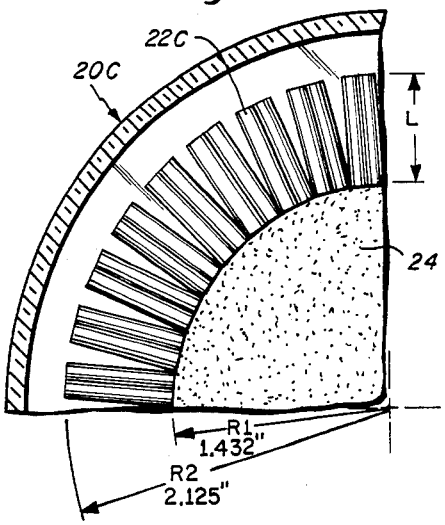

The embodiment of FIG. 4C is in the form of a lens member 20C that has a series of radially disposed flutes 22C each having a length of approximately 0.693 inch. In this embodiment there are a total of thirty-six flutes per lens member. In FIG. 4C, the radius R1 is about 1.432 inches (about the same as in FIG. 1) and the radius R2 is about 2.125 inches (also about the same as FIG. 2). In FIG. 4C, there is also provided a stippled portion 24 bounded on the outside by the fluted portion. Stippling does not extend to the fluted portion.

Figure 4D:
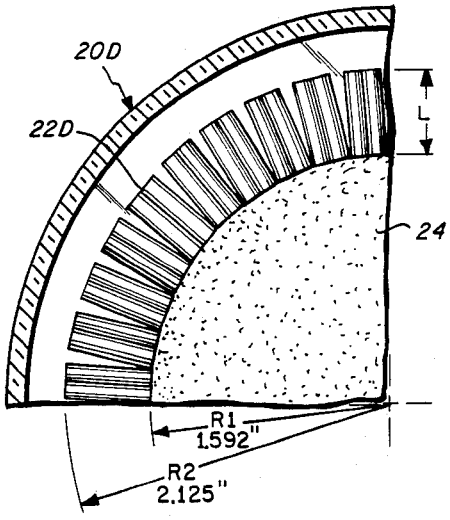

Finally, in FIG. 4D, there is shown a lens member 20D that has an outer radially disposed fluted portion comprised of flutes 22D surrounding an inner stippled portion 24. In FIG. 4D the radius R1 is about 1.592 inches and the radius R2 is 2.125 inches, these being about the same as in the embodiment of FIG. 4B. As with the embodiment of FIG. 4B, in FIG. 4D there are forty flutes per lens member and the length of each flute is about 0.533 inch.

Figure 5:
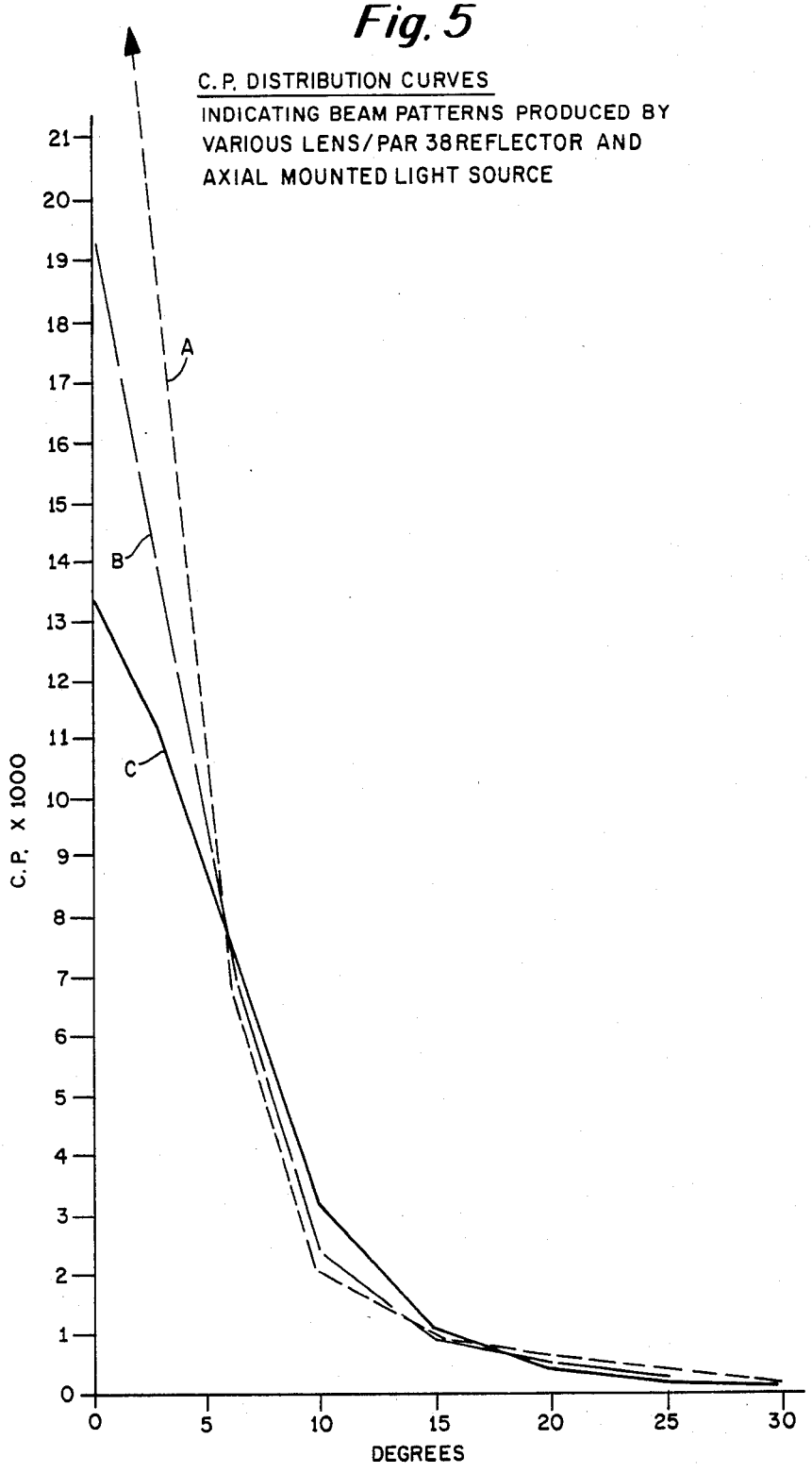
FIG. 5 is a graph (candlepower versus degrees from lamp axis) showing a series of candlepower distribution curves for different spot lamp constructions, including that of the instant invention.

FIG. 5 is a graph of candlepower versus degrees (from lamp axis projected through the center of the illuminated field) for a limited number of lamps, some of which have been constructed in accordance with the principles of the present invention. In FIG. 5 there is shown a first curve A that shows a spot lamp lens which employs a stippled surface only. The candlepower distribution plot possesses a very high peak, but is characterized by very little beam spread. The lamp associated with curve A also produces a substantially "pinwheel" pattern, particularly when used with an axially mounted filament as the light source. In FIG. 5, the curve B depicts a lamp of the type described in the aforementioned copending application Ser. No. 380,495. This is characterized by a medium high peak and also only a slight spread. In FIG. 5, all of the curves indicate beam patterns produced by the different lenses noted when used with an axially mounted light source. Thus, as indicated previously, with regard to curve B there is still provided some "pinwheel" pattern, although this pattern is somewhat reduced. Finally, in FIG. 5 there is shown the curve C which is representative of the spot lamp of the present invention, said lamp employing the defined combination of radially disposed flutes with a centrally disposed stippled portion (i.e., FIG. 2). It is noted that this provides for both the substantial elimination of the "pinwheel" beam pattern, and also provides for improved beam spread.

While there have been shown and described what are at present considered the preferred embodiments of the invention, it will be obvious to those skilled in the art that various changes and modifications may be made therein without departing from the scope of the invention as defined by the appended claims.

What is claimed is:

1. In a spot lamp including a reflector portion, a lens member adjacent said reflector portion, and a light source disposed within said reflector portion and substantially surrounded thereby, the improvement wherein said lens member comprises:

a substantially curved member having an inner surface including therein a substantially centrally disposed stippled portion and a series of radially disposed flutes defining a fluted portion substantially surrounding said centrally disposed stippled portion, each of said flutes extending linearly from adjacent said stippled portion outwardly in a radial manner to a location substantially adjacent the outer edge of said curved member.

2. The improvement according to claim 1 wherein said first surface of said curved member is curved in a direction toward said light source within said reflector portion.

3. The improvement according to claim 2 wherein said curved member further includes an outer, second surface substantially parallel to said first surface, said second surface being substantially smooth.

4. The improvement according to claim 1 wherein the number of flutes formed within said inner surface is within the range of from about thirty-six to about seventy-two.

5. The improvement according to claim 1 wherein said light source comprises an axially mounted filament.

6. The improvement according to claim 5 wherein the candlepower distribution of said spot lamp is controllable by varying the number, shape and location of said flutes and/or the density of stipples within said stippled portion.

7. The improvement according to claim 1 wherein the length of each flute is within the range of from about 0.377 inch to about 0.693 inch, said lens member being substantially circular in configuration and having an outer diameter of about 4.750 inches.

8. The improvement according to claim 1 wherein said radially disposed flutes are arranged in an inner array and an outer array substantially surrounding said inner array, the stippling comprising said stippled portion being located between the flutes comprising said inner array.

9. The improvement according to claim 1 wherein the surfaces of all of said flutes include stipples therein.

10. The improvement according to claim 1 wherein each of said flutes is of a substantially tapered configuration having a narrower width at the end thereof nearest the center of said lens member than the width thereof nearest said outer edge.

11. The improvement according to claim 1 wherein said reflector portion of said spot lamp includes at least three different reflecting surfaces therein.

12. The improvement according to claim 11 wherein two of said surfaces are of substantially spherical configuration and the third of said surfaces is of substantially parabolic configuration.

* * * * *